United States Patent [19]

Robinson

[11] Patent Number: 4,754,858

[45] Date of Patent: Jul. 5, 1988

[54] CUSHIONING PAD FOR LUGGAGE HANDLES

[76] Inventor: Mark Robinson, 14209 Clarendon Dr., Tampa, Fla. 33624

[21] Appl. No.: 21,802

[22] Filed: Mar. 4, 1987

[51] Int. Cl.[4] ..... A45C 13/28; B65D 25/28; B65D 63/18

[52] U.S. Cl. ..... 190/115; 190/39; 16/114 R; 16/116 A; 224/264; 206/279; 2/20

[58] Field of Search ..... 190/102, 108, 115–117, 190/39; 224/264; 2/20; 220/902; 16/110 R, 114 R, 116 R, 116 A; 206/315.3, 279

[56] References Cited

U.S. PATENT DOCUMENTS

| | | | |
|---|---|---|---|
| 1,008,604 | 11/1911 | Lake | 16/114 R |
| 1,742,867 | 1/1930 | Levi | 16/110 R |
| 2,239,180 | 4/1941 | Kupfer | 16/114 R X |
| 2,274,605 | 2/1942 | Hoffmeister | 16/116 A X |
| 3,564,590 | 2/1971 | Hebei | 224/264 X |
| 3,747,654 | 7/1973 | Wilson | 206/315.3 |
| 3,788,308 | 1/1974 | Simpson | 224/264 X |
| 4,262,385 | 4/1981 | Norman | 16/114 R |
| 4,340,990 | 7/1982 | Seynhaeve | 190/115 X |

FOREIGN PATENT DOCUMENTS

| | | | |
|---|---|---|---|
| 111186 | 11/1928 | Austria | 190/115 |
| 673260 | 1/1930 | France | 190/115 |
| 2406402 | 6/1979 | France | 224/264 |

*Primary Examiner*—William Price
*Assistant Examiner*—Sue A. Weaver
*Attorney, Agent, or Firm*—Milton S. Gerstein; Marvin Benn

[57] ABSTRACT

A cushioning pad for relieving the strain of carrying luggage, which pad is removable and attachable to a plurality of luggage pieces by means of a pair of stretchable elastic bands provided in the cushioning pad by through holes positioned at each end thereof. The cushioning pad of the present invention can be used on hand-held luggage, as well as luggage using a strap for carrying the luggage over the shoulder, such as garment bags. The stretchable elastic bands are used to not only secure the cushioning pad to the luggage handle or strap, but are also used to join a plurality of luggage pieces using the same cushioning pad. A plurality of hangers contained within one garment bag can also be joined together by one of the pair of elastic bands, with the other one of the pair of elastic bands used to secure the cushioning pad to the handle of the garment bag.

6 Claims, 3 Drawing Sheets

CUSHIONING PAD FOR LUGGAGE HANDLES

BACKGROUND OF THE INVENTION

The present invention is directed to a pad for use in helping to relieve the stress and strain from carrying luggage and the like by providing a separate and removably attachable cushioned pad to the handle of the luggage. It is known that when carrying heavy luggage by the handle thereof for any length of time, excessive strain is imposed upon the muscles of the forearm, as well as excessive stress on the joints of the hand, which joints are typically curved around the handle of the luggage in order to hold onto the luggage. Depending upon the weight of the luggage itself, the forearm muscles and joints of the hand become overexerted when carrying the luggage for a period of time. Also, in the case of overly-large shoulder luggage where a strap is looped over the shoulder and the shoulder is carrying the weight of the luggage, the surface juncture between the strap and shoulder area often becomes unduly strained after prolonged carrying. The cushioning pad of the invention is, also, ideally suited for use in shoulder-carried luggage. The invention has special use for arthritis sufferers who, more than others, feel the pain and discomfort from prolonged carrying of hand and shoulder luggage.

SUMMARY OF THE INVENTION

It is, therefore, the main objective of the present invention to provide a cushioning pad for use with either the handle of hand-carried luggage, or with the shoulder strap of shoulder-carried luggage, in order to cushion the portion of the person's body in contact with the piece of luggage.

It is another objective of the present invention to provide such a cushioning pad that will evenly distribute the weight of the luggage over the entire area of the body portion bearing the brunt of weight of the luggage.

It is still another objective of the present invention to allow for the same cushioning pad to be used either on the handle of hand-carried luggage or on the strap of should-carried luggage.

It is yet another objective of the present invention to allow for the same cushioning pad to be used for various sizes and shapes of luggage, such that the cushioning pad may be attached to that portion of luggage by which it is carried, will readily adapt to the size or shape of that portion of the luggage, and will allow for the cushioning pad to be extended to fit the size of the handle or strap of the luggage.

Toward these and other ends, the cushioning pad of the present invention is made of a foam, such as MLC "ENSOLITE," to which is attached a pair of stretchable. elastic attaching bands, with each band having two free ends by which the elastic bands and, therefore, the attached foam pad may be secured to the handle of hand-carried luggage or to the strap portion of shoulder-carried luggage. The elastic bands allow for the variable extension of the foam pad relative to the anchoring portions to which it is attached, in order that the foam pad may be stretched to suit the particular size and shape of the handle or strap with which it is associated, so that it may be properly positioned between the handle, or strap, and the hand, or shoulder, of the person carrying the luggage. The elastic bands may also be used for tying together more than one piece of luggage, so that the handles or shoulder straps may be tied together, with the the same foam pad used to carry a plurality of luggage pieces. The elastic bands are also used to tie together the hook portions of hangers used in a garment bag or the like, which hooks protrude outwardly from the opening in the garment bag, with the cushioning pad used to cushion the plurality of hooks.

BRIEF DESCRIPTION OF THE DRAWINGS

The invention will be more readily understood with reference to the accompanying drawings, wherein.

DETAILED DESCRIPTION OF THE INVENTION

Figure 1:
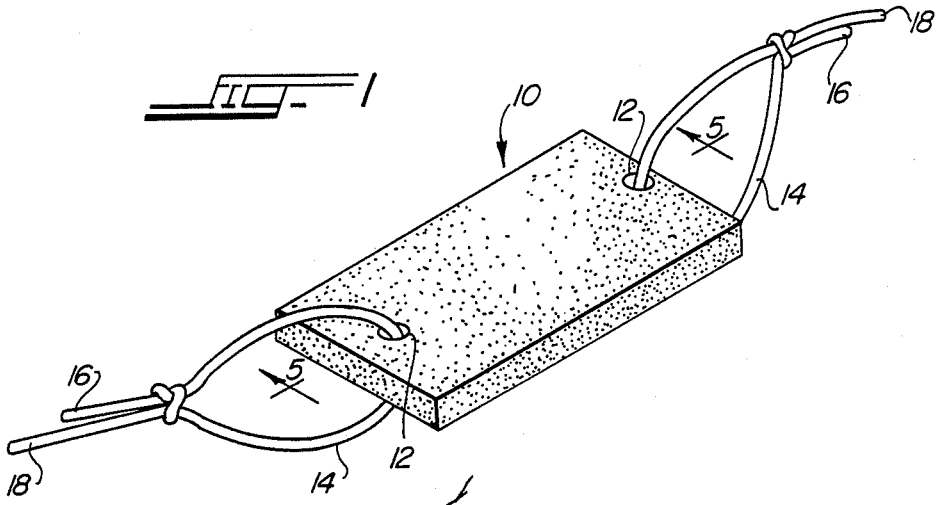
FIG. 1 is a perspective view of the cushioning pad with the attached stretchable bands of the invention.
Figure 2:
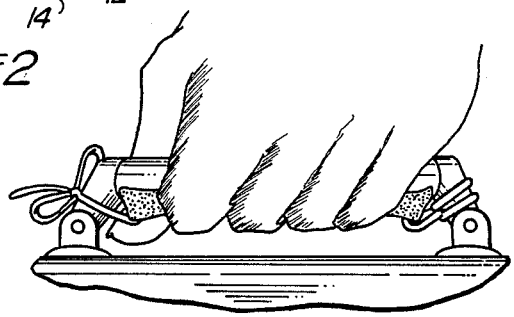
FIG. 2 is a plan view showing the cushioning pad with attached stretchable bands thereof secured to a handle of a piece of hand-carried luggage for cushioning the handle as well as reducing the stress and strain on the hand and forearm.
Figure 3:
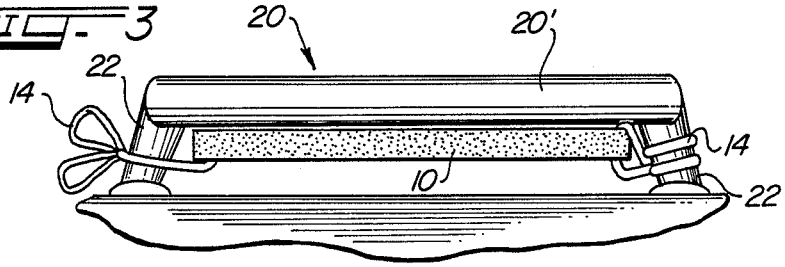
FIG. 3 is a view similar to FIG. 2, showing the cushioning pad secured to the handle of the hand-carried luggage without the hand gripping the handle.
Figure 4:
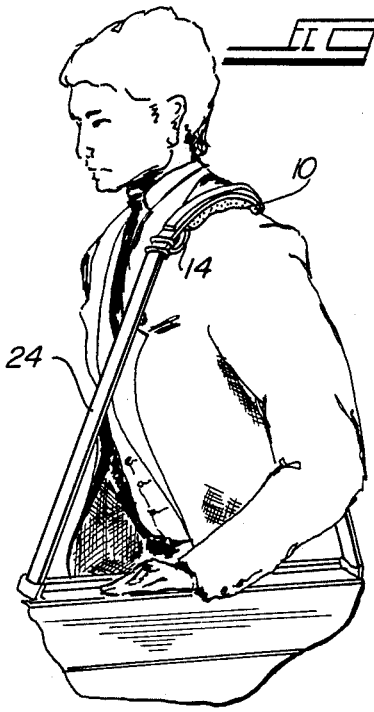
FIG. 4 is a perspective view showing the cushioning pad of the invention secured to a portion of a shoulder strap of shoulder-carried luggage for cushioning the shoulder blade area upon which is borne the weight of the shoulder-carried luggage.
Figure 5:
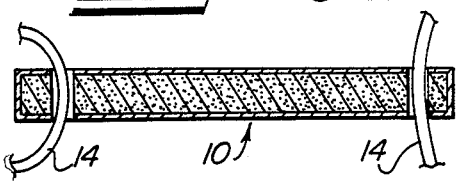
FIG. 5 is a cross-sectional view taken along line 5—5 of FIG. 1.

Referring now to the drawings in greater detail, the cushioning pad of the invention is indicated generally by reference numeral 10 in FIG. 1. The pad 10 is preferably rectangular in cross section, and is preferably made of a foam such as Uniroyal's MLC "ENSOLITE," which is a polyvinyl chloride in compound with nitrile rubber, oils, plasticizers and cellogen. Alternatively, the foam may be made of MFC "ENSOLITE," which is also manufactured by Uniroyal, Inc. MLC "ENSOLITE" has a density of 3 to 4.5 pounds per cubic feet, in a 25% compression resistance between 1.5 and 3.0 psi with a tensile strength of 30 psi, minimal elongation of 200%, and has a 15% loss of height for a 50% compression ratio over a 24-hour recovery period. In the preferred embodiment, the cushioning pad 10 is coated with colored vinyl, by well-known methods. The cushioning pad 10 is provided with through holes 12 through which is threaded stretchable elastic bands or cords 14 each having two free ends 16 and 18 that are used for tying and attaching the cushioning pad 10 to a handle 20 of a piece of hand-carried luggage, or to a portion of a shoulder strap 24 of a piece of shoulder-carried luggage, as clearly shown in FIG. 4. In attaching the elastic bands 14 to the handle 20, the free ends of one of the pair of elastic bands are first attached to one of the short projecting parts 22 by a slip knot, so that the pad 10 may be pulled away from portion 22 a desired distance to position it under the main portion 20' of the handle at a desired location best suited to the size of the handle 20, as well as to the size of the hand and grip of the person carrying the luggage. After attaching the cushioning pad 10 to the handle 20, the second one of the pair of elastic bands 14 is attached to the other of the short projection parts 22 of the handle, so that the cushioning pad 10 is secured between the two angularly-extending parts 22 of the handle. The elastic bands 14 allow for the same cushioning pad 10 to be used for any sized luggage and various sizes of handles 20, since the elastic bands 14 can be stretched to position the cushioning pad 10 to accommodate any gripping portion 20'. Thus, the same cushioning pad 10 may be used on any piece of luggage. As shown in FIG. 4, the same cushioning pad 10 may also be used on a shoulder strap for a shoulder-carried piece of luggage by attaching each of the pair of elastic bands 14 via the ends 16 and 18 to the portion of the shoulder strap 24 that comes in contact with the carrier's shoulder. The cushioning pad 10, as clearly shown in FIG. 4, is positioned between the shoulder blade and the strap itself in order to cushion and evenly distribute the force of the weight of the shoulder-carried luggage over the entire shoulder area, and to prevent rubbing of the shoulder by the frictional force between the strap 14 and the shoulder. The elastic bands 14 are preferably made of natural rubber, with a covering or coating of filament nylon, and in the preferred embodiment have an elongation of at least 180% without any recognizable or permanent deformation thereof. Preferably, the length of each of the elastic bands 14 is 5 inches, while the cushioning pad 10 is 4 inches long, 2 inches wide, and $\frac{3}{4}$ of an inch thick.

Figure 6:
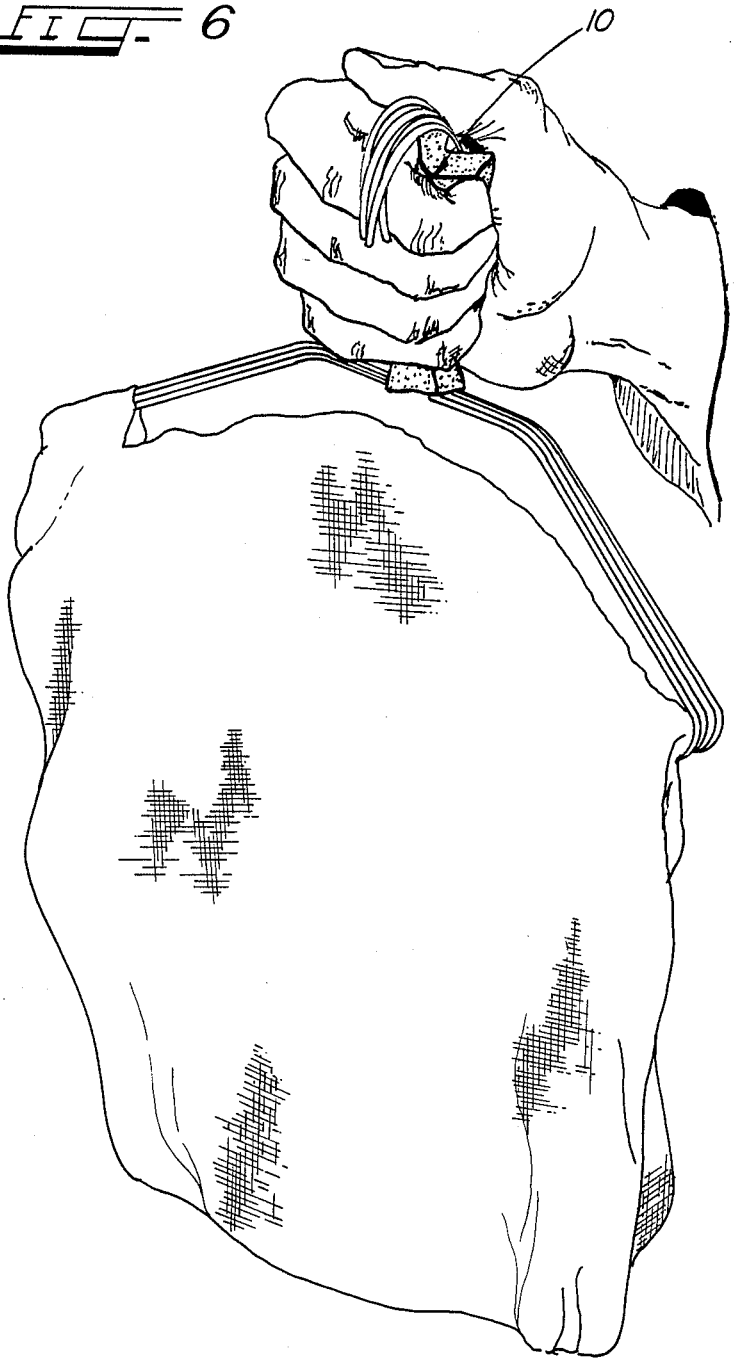
FIG. 6 is a perspective view showing the use of the cushioning pad of the invention with a plurality of hangers of a garment bag for carrying the garment bag.
Figure 7:
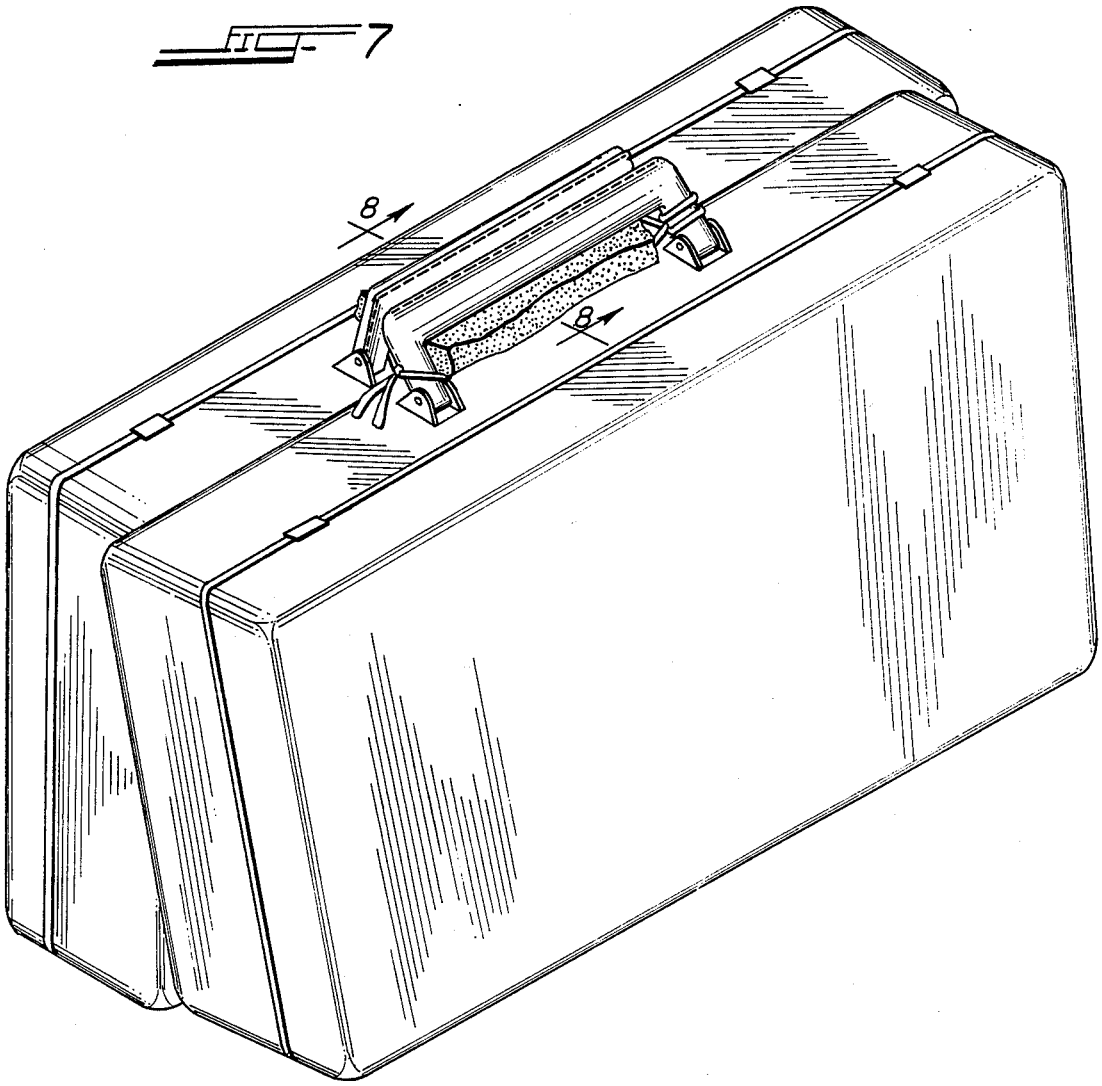
FIG. 7 is an isometric view showing the cushioning pad of the invention being used with a pair of suitcases, or the like, arranged side-by-side.
Figure 8:
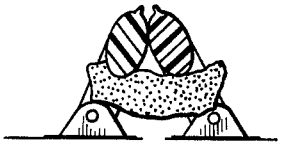
FIG. 8 is a cross-sectional view taken along line 8—8 of FIG. 7.

FIG. 6 discloses the use of the same cushioning pad 10 for cushioning and tying together a plurality of hangers carrying clothing within a garment bag. One or both of the pair of elastic bands 14 are first tied around all of the hanger hooks to thereby tie them together, with the cushioning pad 10 thereafter being placed at an appropriate position relative to the plurality of hooks by which a person's hand may grip the hooks and carry the garment bag in a safer, less tiring and more comfortable manner, as hitherto possible.

While a specific embodiment of the invention has been shown and described, it is to be understood that numerous changes and modifications thereof may be made without departing from the scope, spirit and intent of the invention, as set out in the appended claims.

What is claimed is:

1. In a piece of hand-carried luggage, which luggage includes a main body portion for storing items therein, and a handle portion for gripping and carrying the luggage, said handle portion having an elongated hand-gripping portion, and a pair of angularly-extending portions for spacing said hand-gripping portion from the surface area of said main body portion, wherein the improvement comprises:

a cushioning pad made of a foam-like material for absorbing and distributing forces, said cushioning pad having at least one through hole formed therein, said through hole positioned adjacent an end of said cushioning pad;

at least one stretchable elastic band means passing through said at least one through hole and removably-attached to one of said pair of angularly-extending portions of said handle of said luggage, so that said cushioning pad is positionable between the lower surface area of said elongated hand-gripping portion and the adjacent juxtaposed outer surface of said main body portion of said luggage, whereby said cushioning pad may be positioned under said hand-gripping portion of said handle to separate said hand-gripping portion therefrom in order to cushion the handle thereof, as well as to evenly distribute the force of the weight of the luggage and to secure said cushioning pad to said hand-gripping portion;

said at least one stretchable elastic band means comprising at least one free end by which said at least one elastic band means may be secured to said one of said pair of angularly-extending portions.

2. The improvement according to claim 1, wherein said at least one stretchable band means comprises a pair of said stretchable elastic band means, said at least one through hole comprising a pair of through holes, each said through hole positioned adjacent a respective end of said cushioning pad and receiving therethrough one of said pair of stretchable elastic band means.

3. The improvement according to claim 1, comprising at least a pair of said pieces of hand-carried luggage juxtaposed such that said handle portions thereof are in approximate alignment with each other; said elastic band means being removably attached to said angularly extending portions of said handle portions of each said piece of handcarried luggage to thereby unite said handles together, whereby said cushioning pad may be used under both of the elongated hand-gripping portions of said pieces of luggage when a hand grips both of said handles together.

4. The improvement according to claim 2, wherein each of said elastic band means has a length of 5 inches, and said cushioning pad is substantially rectilinear in cross section.

5. A method of alleviating the stress and strain of carrying luggage and the like comprising:

(a) removably attaching a cushioning pad to the portion of the luggage by which it is carried, which portion by which it is carried contacts a portion of a person's body by which the luggage is carried;

(b) positioning the cushioning pad between the portion of the luggage by which it is carried and the portion of the person's body that contacts the luggage;

(c) carrying the luggage after said step (b) so that the positioning pad is sandwiched between the portion of the luggage by which it is carried and the portion of the body by which it carries the luggage;

(d) doffing the luggage from the portion of the person's body in contact with the cushioning pad, and thereafter removing the cushioning pad from its connection with the portion of the luggage by which it is to be carried;

said step (a) comprising removably affixing the cushioning pad by securing a pair of elastic bands therethrough, and attaching the free ends of the elastic bands to the portion of the luggage which is to be associated with the portion of person's body carrying the luggage;

said step (a) further comprising attaching the free ends of the pair of elastic bands to at least a pair of handles of hand-carried pieces of luggage and positioning the cushioning pad such that it lies between the elongated hand-gripping portions of the handles of said pieces of luggage and a main body portion thereof.

6. The method according to claim 5, further comprising removing the free ends of the elastic bands and the cushioning pad from the handles, and removably attaching the free ends of both of the pair of stretchable elastic bands around a plurality of hanger hooks protruding from a garment bag, and positioning the cushioning pad along the hangers' hooks, by which the hangers may be carried.

* * * * *